US005843367A

United States Patent [19]

Dormal et al.

[11] Patent Number: 5,843,367

[45] Date of Patent: Dec. 1, 1998

[54] DEVICE FOR THE ACCELERATED COOLING OF A CONTINUOUS SUBSTRATE MOVING RAPIDLY IN A VERTICAL PLANE

[75] Inventors: Benoit Dormal, Tilff; Pierre Simon, Embourg; Stephan Wilmotte, Chaudfontaine, all of Belgium

[73] Assignee: Centre de Recherche Metallurgiques A.S.B.L., Brussels, Belgium

[21] Appl. No.: 666,408

[22] PCT Filed: Sep. 27, 1995

[86] PCT No.: PCT/BE95/00089

§ 371 Date: Jun. 26, 1996

§ 102(e) Date: Jun. 26, 1996

[87] PCT Pub. No.: WO96/13619

PCT Pub. Date: May 9, 1996

[30] Foreign Application Priority Data

Oct. 26, 1994 [BE] Belgium ..... 9400973

[51] Int. Cl.[6] ..... C21D 1/62

[52] U.S. Cl. ..... 266/113; 266/114

[58] Field of Search ..... 266/102, 103, 266/113, 114

[56] References Cited

U.S. PATENT DOCUMENTS

| | | | |
|---|---|---|---|
| 3,428,023 | 2/1969 | Cox et al. | 118/68 |
| 3,853,306 | 12/1974 | Padjen et al. | 266/3 |
| 4,361,448 | 11/1982 | Sippola | 266/113 |
| 4,367,597 | 1/1983 | Iida et al. | 34/155 |
| 4,407,487 | 10/1983 | Wang | 266/113 |

FOREIGN PATENT DOCUMENTS

| | | |
|---|---|---|
| 568185 | 12/1987 | Australia . |
| 0395759 | 11/1990 | European Pat. Off. . |
| 2130324 | 11/1972 | France . |

OTHER PUBLICATIONS

Patent Abstracts of Japan, vol. 5, No. 152, Sep. 25, 1981.
Patent Abstracts of Japan, vol. 5, No. 148, Sep. 18, 1981.
Patent Abstracts of Japan, vol. 6, No. 143, Aug. 3, 1982.
Patent Abstracts of Japan, vol. 7, No. 151, Jul. 2, 1983.
Patent Abstracts of Japan, vol. 8, No. 168, Oct. 7, 1982.

*Primary Examiner*—Scott Kastler
*Attorney, Agent, or Firm*—Jacobson, Price, Holman & Stern, PLLC

[57] ABSTRACT

Device for the accelerated cooling of a continuous substrate moving rapidly in a vertical plane, formed by a closed chamber, which includes, in succession in the direction of travel of the substrate, at least one so-called main cooling zone provided with coolant injectors, a so-called secondary cooling zone promoting contact between the coolant and the substrate, a coolant extraction zone and coolant retainers both at the inlet and outlet of the cooling device. The main cooling zone includes, spray injectors for forming one or more water/air fog curtains arranged in space so that they come into direct contact with the substrate to be cooled.

6 Claims, 2 Drawing Sheets

DEVICE FOR THE ACCELERATED COOLING OF A CONTINUOUS SUBSTRATE MOVING RAPIDLY IN A VERTICAL PLANE

FIELD OF THE INVENTION

The present invention relates to a device for the accelerated cooling of a continuous substrate moving rapidly in a vertical plane, more particularly a coated metal strip, for example a hot-galvanized sheet.

The cooling device, which is the subject of the present invention, will be intentionally described for the purpose of making it easier to understand within the scope of its use when cooling a galvanized steel strip after a galvannealing heat treatment, but this description in no way precludes the device of the invention from being able to be applied in other circumstances requiring similar cooling conditions.

BACKGROUND OF THE INVENTION

The heat treatment called "galvannealing" consists in subjecting a hot-galvanized steel sheet successively to a heating operation, a temperature hold and then a cooling operation.

The purpose of this treatment is to ensure that iron in the sheet diffuses through the coating layer, generally a zinc or zinc-alloy coating layer, so as to obtain iron contents of between 7% and 13% in the aforementioned coating layer. This heat-treatment operation has the effect of producing a coating having better drawability and weldability.

The conventional galvannealing operation is carried out in a plant in which the sheet performs at least two vertical passes, namely an ascending pass and a descending pass.

Diagrammatically, the sheet may be said to leave the galvanizing bath vertically to start its ascending phase and, directly after the wiping device consisting of air knives, enters a heating oven which heats the sheet to a temperature of between 460° C. and 600° C.; next, the sheet travels through a temperature-hold oven. Lying above this oven is at least one cooling device intended to ensure that the coating on the sheet solidifies in such a way that this coating is not damaged on the guide rollers terminating the ascending phase and guiding the sheet into the descending phase.

After the galvannealing operation, the quality of the coating obtained has proved to be directly related to the diffusion of iron into the zinc or zinc-alloy layer and this quality is favourably influenced by a sufficiently long temperature-hold duration, for example greater than 10 seconds.

Now, the length of the ascending phase is limited by mechanical-construction problems and by problems of controlling the vibrations produced in the sheet at the air knives.

SUMMARY OF THE INVENTION

In order to use to the best advantage the plant length available for carrying out the heating, temperature-hold and cooling operations before the sheet passes over the guide rollers located at the top of the ascending phase, the Applicant has developed a process in which both the heating power and the cooling flux are increased so as to limit the space required for these two operations and thereby to maintain a length sufficient to obtain as long as possible a passage time in the temperature-hold oven with a view to obtaining optimum conditions for the diffusion of iron into the coating layer; the cycle thus produced approaches an ideal so-called "square" cycle.

The subject of the present invention is an accelerated cooling device of short length, which is particularly suitable to be used for rapidly cooling, by means of nozzles spraying a water/air fog, a coated substrate after the latter has exited from a temperature-hold oven and before it passes over guide rollers, especially within the framework of galvannealing treatment.

The device for the accelerated cooling of a continuous substrate moving rapidly in a vertical plane, which is the subject of the present invention, formed by a closed chamber, is essentially characterized in that it comprises, in succession in the direction of travel of the substrate, at least one so-called main cooling zone provided with coolant injection means, a so-called secondary cooling zone promoting contact between the coolant and the substrate, a coolant extraction zone and coolant retention means both at the inlet and outlet of the cooling device.

According to one embodiment of the cooling device of the invention, the main cooling zone includes means for forming one or more water/air fog curtains arranged in space so that they come into direct contact with the substrate to be cooled.

According to a preferred embodiment of the cooling device of the invention, the means for forming one or more fog curtains comprise fog spray injectors, the aforementioned injectors advantageously consisting of two pipes whose longitudinal axes are parallel to the plane of movement of the substrate to be cooled, one enclosing the other, and one of the aforementioned pipes being supplied with water and the other with air, and consisting of nozzles supplied with air and water via the two aforementioned pipes so as to form the fog curtains.

According to yet another preferred embodiment of the cooling device, the spray injectors are designed to spray the said fog curtains at an angle of between 30° and 60°, preferably between 35° and 40°, with respect to the direction of movement of the substrate to be cooled.

According to another embodiment of the cooling device, which is the subject of the present invention, the secondary cooling section includes specific means for promoting contact between the substrate to be cooled and the coolant injected into the main cooling section.

According to another preferred embodiment of the device, which is the subject of the invention, it includes means for sucking and removing the coolant from the closed chamber of the said cooling device and preferably the said means are located close to the upper end of the aforementioned device.

According to yet another preferred embodiment of the device of the invention, the aforementioned removal means comprise hoods for sucking out the fog used as coolant.

According to one advantageous embodiment of the device of the invention, the product enters and leaves the device through means intended to prevent the coolant from escaping from the closed chamber, both at the inlet downwards and at the outlet upwards; the aforementioned means preferably consist of compressed-air jets suitably directed so as to confine the coolant within the closed chamber.

The preceding embodiment provides a very effective solution to the technical problems posed, respectively, on the one hand by water falling into the bath of molten zinc and on the other hand by coolant being driven out of the chamber and coming into contact with the upper guide rollers.

BRIEF DESCRIPTION OF THE DRAWINGS

The following description relates to a particular construction and will be explained with reference to the appended drawings, in which.

DETAILED DESCRIPTION OF THE PREFERRED EMBODIMENTS

The aforementioned figures constitute diagrammatic representations in which only the elements necessary for clearly understanding the invention have been reproduced.

Figure 1:
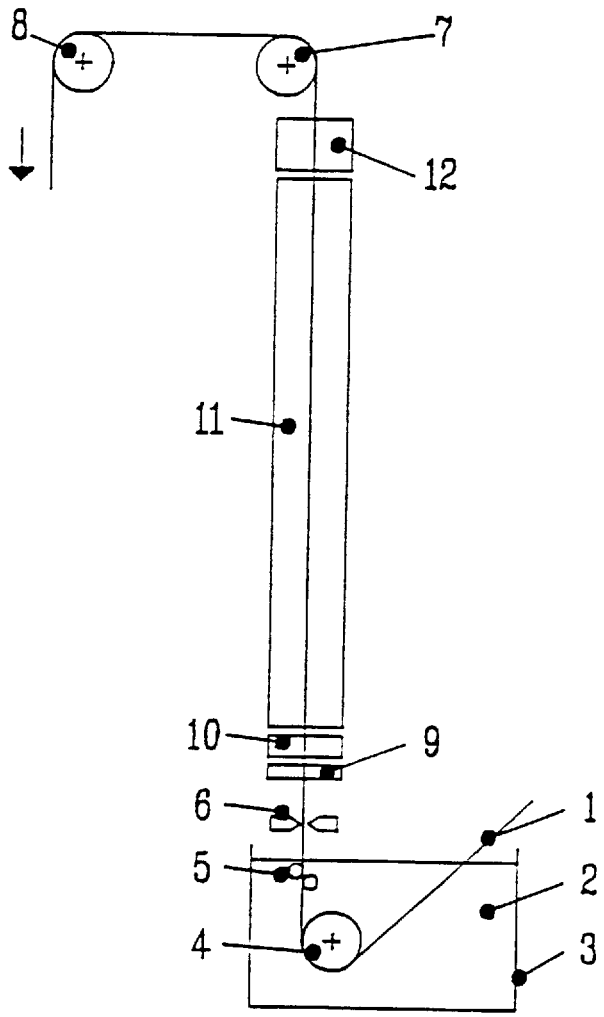
FIG. 1 illustrates the principle of the galvannealing heat treatment.

FIG. 1 shows that the substrate 1 passes through the zinc or zinc-alloy bath 2 contained in the galvanizing tank 3, leaves the latter vertically after being guided around the roller 4, passes through a roller guide system 5, is wiped at the wiping device 6, consisting of air knives the purpose of which is to adjust the thickness of the coating layer on the substrate. The latter then starts a vertical ascending path up to a second guide roller 7, follows a horizontal path to the third guide roller 8 and then redescends in a vertical path down to a subsequent operation.

During the ascending path between the rollers 4 and 7, the substrate passes through a short rapid-heating device 9, then a short temperature-evening device 10, a much longer temperature-hold device 11 and finally a short rapid-cooling device 12 equipped with water/air fog injectors.

Figure 2:
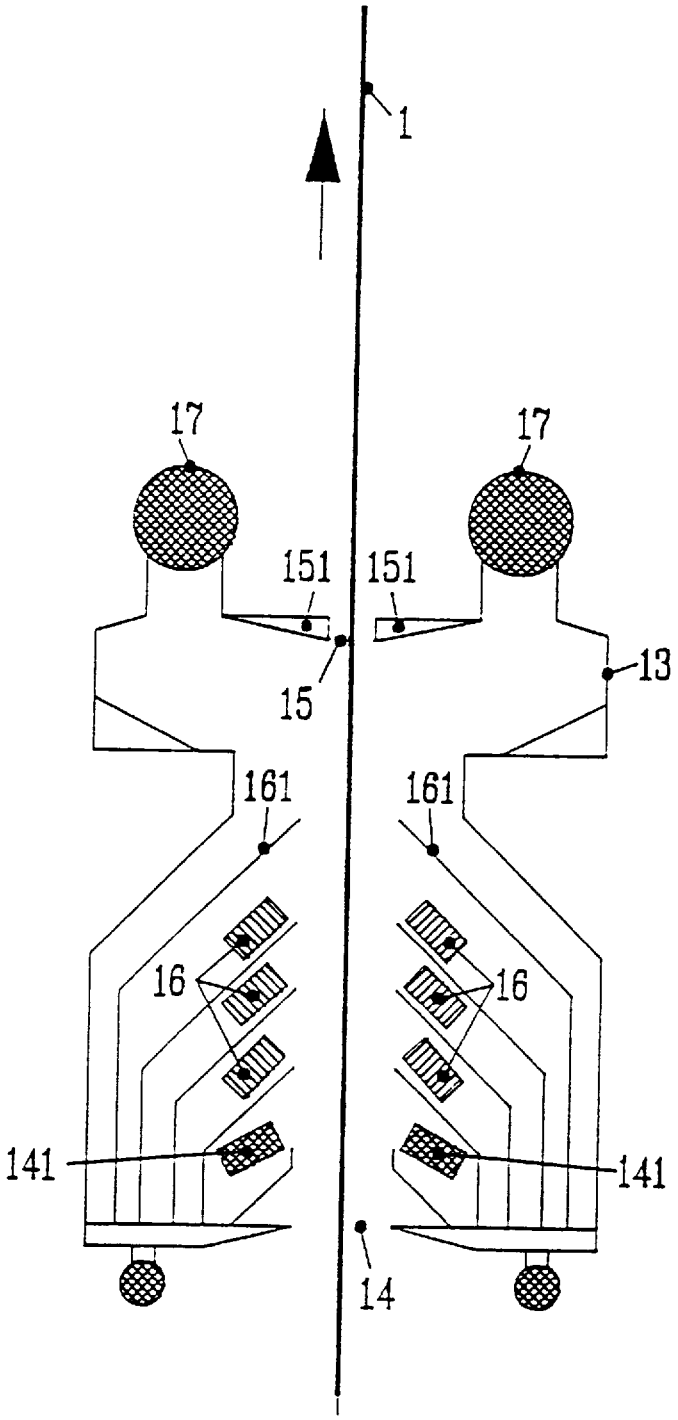
FIG. 2 represents an overall view of the cooling device of the invention.

FIG. 2 illustrates a preferred embodiment of the device 12 for a rapid cooling of a coated substrate.

This FIG. 2 shows the closed chamber 13 enclosing the rapid-cooling device, the substrate 1 to be cooled, the inlet 14 provided with compressed-air dams 141 preventing the coolant from descending towards the galvanizing bath, the outlet 15 provided with compressed-air dams 151 preventing the coolant from escaping towards the upper guide rollers, the water/air fog spray injectors 16 as well as the devices 161, such as deflectors, intended to promote contact between the substrate and the fog, and, finally, the hoods 17 for extracting the fog from the chamber defining the cooling device.

It goes without saying that the above description is intentionally limited to one particular field, such as galvannealing, but nonetheless the fact remains that the present patent application aims to cover any use of the cooling device claimed, independently of the ways and means of application, such as, for example, the type of coolant used.

We claim:

1. A device for the accelerated cooling of a continuous substrate moving rapidly in a vertical plane, said device comprising a closed chamber having a lower inlet end and an upper outlet end and comprising, in succession in the direction of travel of the substrate, a main cooling zone, provided with coolant injectors, a secondary cooling zone, and a coolant extraction zone, said secondary cooling zone including means for promoting contact between coolant and the substrate, said coolant extraction zone including means for sucking and removing the coolant from said closed chamber, said closed chamber including means for retaining the coolant within said closed chamber, said coolant retaining means being located both at the lower inlet end and at the upper outlet end of said closed chamber, said coolant injectors in the main cooling zone including spray injectors for forming water and air fog curtains and said spray injectors being arranged such that the fog curtains come into direct contact with the substrate to be cooled, said spray injectors include two pipes having longitudinal axes extending parallel to a plane of movement of the substrate to be cooled, one pipe enclosing the other, said one of said two pipes being supplied with water and said other of said two pipes being supplied with air, and said spray injectors also including nozzles supplied with water and air by said two pipes, respectively.

2. The device according to claim 1, wherein said spray injectors are directed at an angle between 30° and 60° with respect to the direction of travel of the substrate to be cooled.

3. Device according to claim 2, wherein said angle is between 35° and 40°.

4. Device according to claim 1, wherein said contact promoting means includes deflectors oriented at an angle to the substrate.

5. Device according to claim 1, wherein said sucking and removing means includes hoods located adjacent to the upper outlet end of said closed chamber and communicating with an interior of said closed chamber.

6. Device according to claim 1, wherein said coolant retaining means includes compressed-air jets directed towards the substrate.

* * * * *